US006126162A

United States Patent [19]

Ueda et al.

[11] Patent Number: 6,126,162

[45] Date of Patent: Oct. 3, 2000

[54] SHEET DISTRIBUTION DEVICE

[75] Inventors: Masahiro Ueda, Ibaraki-ken; Yoshihisa Ogasawara, Kofu, both of Japan

[73] Assignees: Nisca Kabushiki Kaisha, Yamanashi-ken; Riso Kagaku Corporation, Tokyo, both of Japan

[21] Appl. No.: 09/036,231

[22] Filed: Mar. 6, 1998

[30] Foreign Application Priority Data

Mar. 12, 1997 [JP] Japan ..... 9-078861

[51] Int. Cl.[7] ..... B65H 43/04; B65H 29/50; B65H 39/10

[52] U.S. Cl. ..... 271/198; 271/200; 271/296; 271/288; 271/303

[58] Field of Search ..... 271/176, 198, 271/200, 303, 296, 288 C

[56] References Cited

U.S. PATENT DOCUMENTS

| | | | |
|---|---|---|---|
| 3,848,867 | 11/1974 | Johnson | 271/173 X |
| 4,451,031 | 5/1984 | McCain et al. | 271/303 |
| 4,621,803 | 11/1986 | Johdai et al. | 271/293 X |
| 4,822,025 | 4/1989 | Chung | 271/296 |
| 4,974,828 | 12/1990 | Matsuo et al. | 271/293 X |
| 5,279,218 | 1/1994 | Oshio et al. | 101/2 X |
| 5,890,050 | 3/1999 | Kaneda | 399/403 X |
| 5,931,464 | 8/1999 | Shimizu et al. | 271/296 |

*Primary Examiner*—William E. Terrell
*Assistant Examiner*—Kenneth W. Bower
*Attorney, Agent, or Firm*—Kane, Dalsimer, Sullivan and Levy, LLP

[57] ABSTRACT

There is disclosed a sheet distribution device in which by using a junction conveying means for conveying sheets from a main sorter unit to a slave sorter unit also as a first conveying portion of the sheet distribution device when sheet distribution devices are interconnected, the manufacture cost of the sheet distribution device is reduced. The interconnectable sheet distribution device is provided with a first conveying portion 5A for receiving an image formed sheet 2 from an image forming device 1 to convey the sheet into a body and a second conveying portion 5B for receiving the sheet 2 from the first conveying portion 5A to convey the sheet to each of plural distribution bins 4. At the time of interconnection, a third conveying portion 5D (junction conveying means) for conveying the sheet 2 from a main sorter unit S1 to a slave sorter unit S2 is used also as the first conveying portion 5A. The sheet distribution device has a space for storing the first conveying portion 5A at the time of interconnection.

8 Claims, 11 Drawing Sheets

(A)

(B)

(A)

(B)

SHEET DISTRIBUTION DEVICE

BACKGROUND OF THE INVENTION

1. Field of the Invention

The present invention relates to a sheet distribution device, particularly to an interconnectable sheet distribution device which is provided with a first conveying means for receiving an image formed sheet from a printer, a copying machine or another image forming device to convey the sheet to a body and a second conveying means for receiving the image formed sheet from the first conveying means to convey the sheet to each of plural distribution bins.

2. Description of the Related Art

A sheet distribution device usually called "sorter" is, as disclosed, for example, in the Japanese Patent Application Laid-open No. Hei 4-43089, provided with plural distribution bins for successively receiving an image formed sheet (hereinafter, referred to as the printed sheet) from a printer, a copying machine or another image forming device to accumulate plural sheets; a first conveying means for conveying the printed sheet from a sheet discharge portion of the image forming device to a vicinity of a top distribution bin; a second conveying means for receiving the printed sheet from the first conveying means to convey the printed sheet to a vicinity of a lowermost distribution bin; and an indexer provided movable vertically along a sheet receiving end of the distribution bin for receiving the printed sheet from the second conveying means to eject and distribute the printed sheet to each distribution bin. In the constitution, when the sheets accumulated on each distribution bin reach a predetermined number or more, a bunch of sheets on the distribution bin are bundled and stapled by using a stapler which can move along the sheet receiving ends of the plural distribution bins.

In the conventional sheet distribution device, in order to increase the number of distribution bins as required, a slave sorter unit can be optionally interconnected to a main sorter unit having the aforementioned constitution. In this case, the slave sorter unit is provided with plural distribution bins similar to those of the main sorter unit, a sheet conveying portion similar to the aforementioned second conveying portion and an indexer which can vertically move in the same manner as in the main sorter unit.

Additionally, an upper portion of the main sorter unit to which the slave sorter unit can be interconnected is provided with a third conveying portion for transferring the printed sheet from the first conveying portion in a horizontal direction to a region above a top distribution bin of the slave sorter unit.

However, in the conventional sheet distribution device, the third conveying portion is fixed beforehand to the main sorter unit. Also, in order to increase the number of distribution bins by interconnecting a second slave sorter unit to the slave sorter unit, the sheet conveying portion similar to the third conveying portion is fixed beforehand to the slave sorter unit.

Therefore, even in a use condition in which only the main sorter unit is sufficient, the unnecessary third conveying portion is provided. This fails to reduce the cost per sorter unit. Also, when the main sorter unit and the slave sorter unit are constituted of a sorter unit for common use, the first conveying portion needs to be removed from the slave sorter unit. The operation is thus complicated. Further, since the main sorter unit is different in configuration from the slave sorter unit, a package box needs to be prepared for each of the units. This is also a factor of cost increase.

SUMMARY OF THE INVENTION

Wherefore, an object of the invention is to provide a sheet distribution device in which by combining a first conveying portion and a third conveying portion (junction conveying portion) for use, a manufacture cost per unit of sheet distribution device is reduced, while an operational process for interconnecting sheet distribution devices is simplified.

To attain this and other objects, the present invention provides an interconnectable sheet distribution device which is provided with a first conveying means for receiving an image formed sheet from an image forming device to convey the image formed sheet into a body and a second conveying means for receiving the image formed sheet from the first conveying means to convey the image formed sheet to each of plural distribution bins. When sheet distribution devices are interconnected, a junction conveying means for conveying the sheet from a sheet distribution device on an upstream side of a sheet conveying direction to a sheet distribution device on a downstream side is used also as the first conveying means. The sheet distribution device has a space for storing the first conveying means at the time of interconnection.

In the sheet distribution device of the invention, the first conveying means and the second conveying means are directly connected via one sheet conveyor belt.

Also in the sheet distribution device of the invention, the first conveying means can be rotated in a vicinity of a region in which the sheet is transferred to the second conveying means.

Also, the sheet distribution device of the invention is provided with a support member for holding a rotated position of the first conveying means.

Also, the sheet distribution device of the invention is provided with a switch mechanism which transfers the image formed sheet conveyed by the first conveying means to either one of the second conveying means and the junction conveying means.

Also, the sheet distribution device is provided with an engagement means for fixing the first conveying means in the space when the first conveying means of the sheet distribution device on the downstream side is inserted to the space in the sheet distribution device on the upstream side of the sheet conveying direction at the time of the interconnection.

Also in the sheet distribution device of the invention, the engagement means is constituted of an engagement groove formed in a tip end bottom of the first conveying means and an engaging pin formed on an inner side in the space for engaging with the engagement groove when the first conveying means is inserted.

Also in the sheet distribution device of the invention, the engaging pin has an engaging groove formed therein for engaging with a peripheral edge of the engagement groove.

DETAILED DESCRIPTION OF THE PREFERRED EMBODIMENTS

Figure 1:
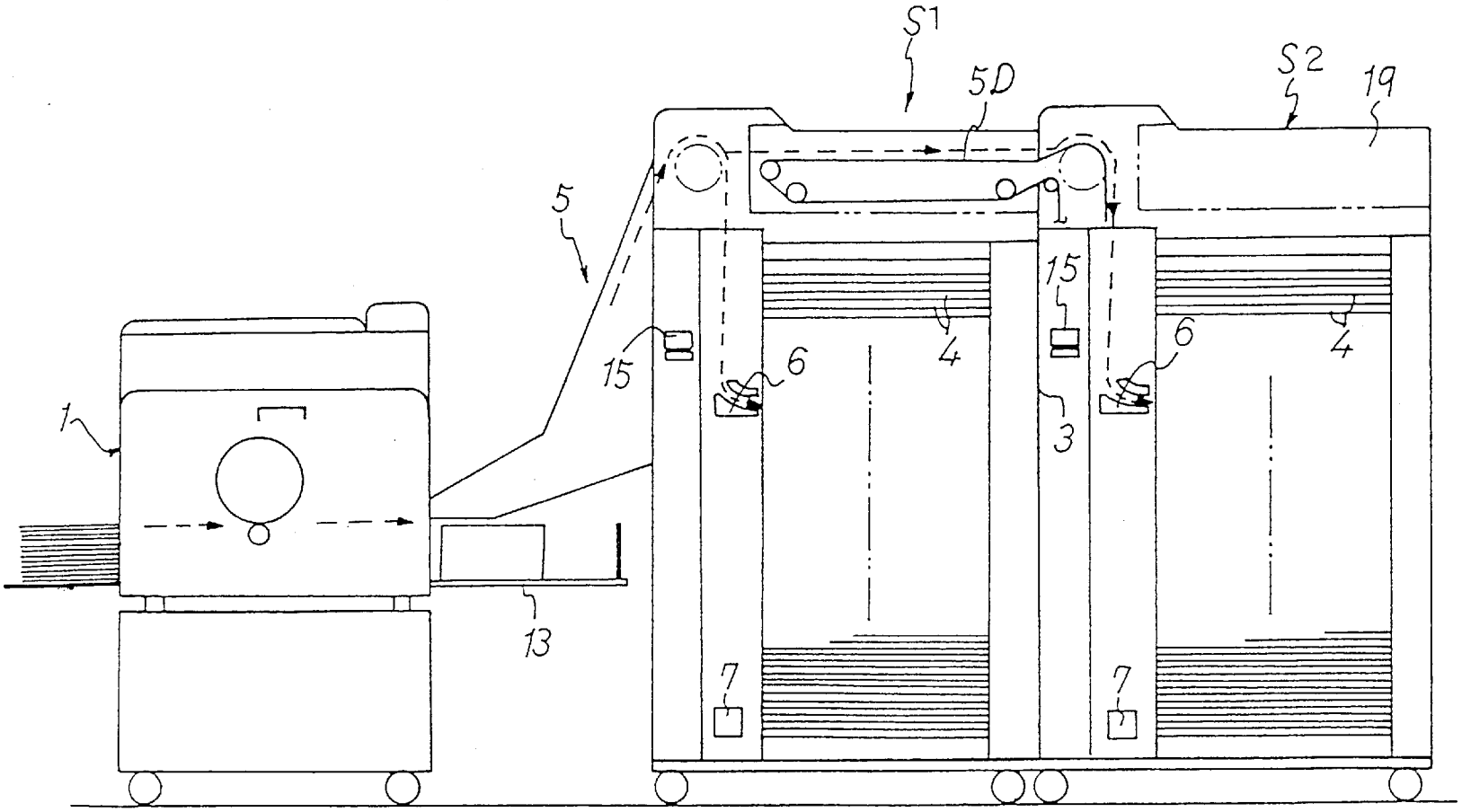
FIG. 1 is a diagrammatic side view showing that a sheet distribution device according to the invention is connected to an image forming device.
Figure 2:
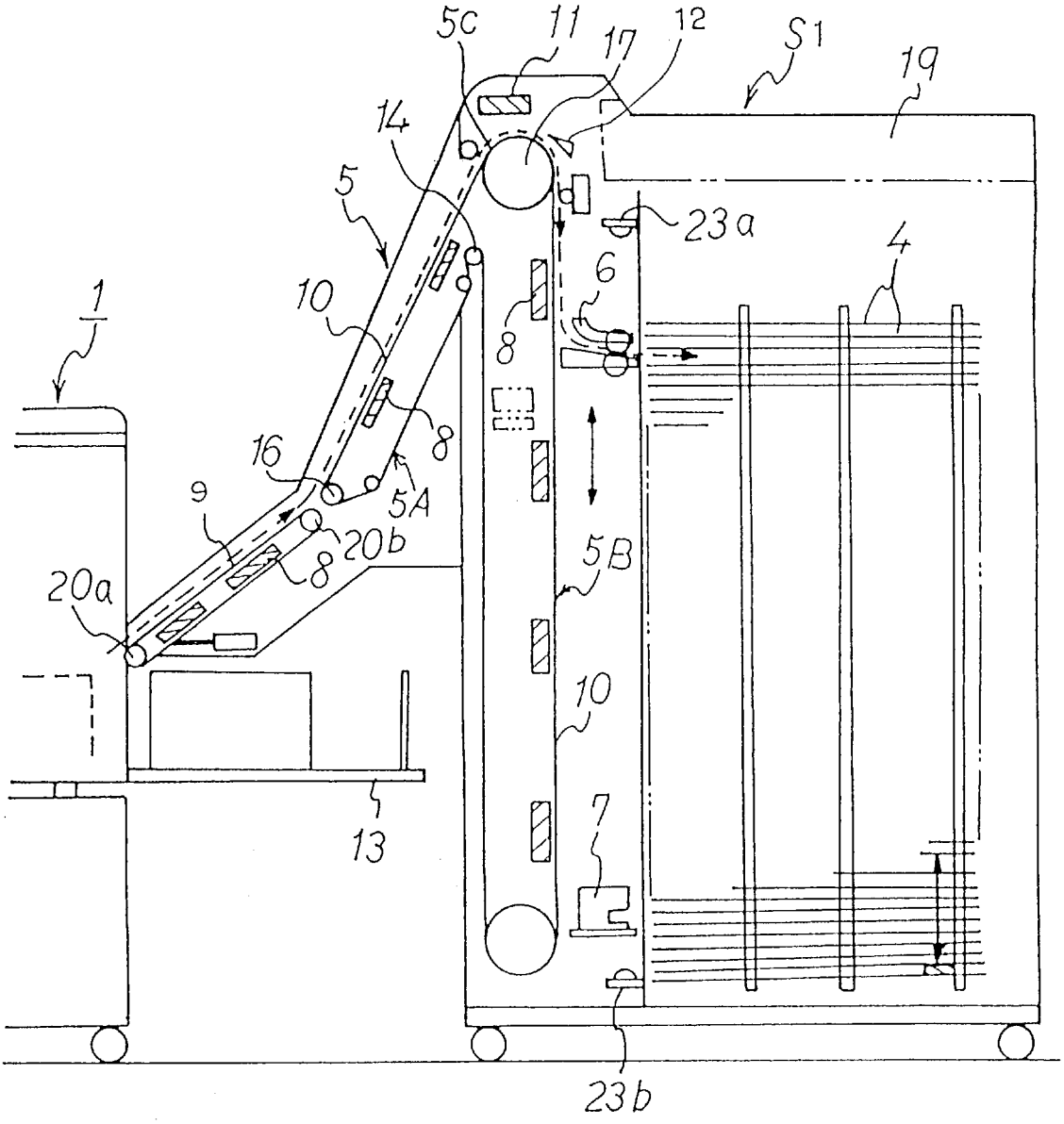
FIG. 2 is a diagrammatic side view showing an inner structure of a main sorter unit of FIG. 1 in a perspective manner.

Embodiments of a sheet distribution device according to the invention will be described with reference to the accompanying drawings. FIGS. 1 and 2 show an entire constitution of the sheet distribution device: FIG. 1 is a diagrammatic side view showing a constitution in which the sheet distribution device is connected to an image forming device; and FIG. 2 is a diagrammatic side view showing an inner structure of a main sorter unit of FIG. 1 in a perspective manner.

A sheet distribution device S is provided with plural distribution bins 4 constituted of plural, e.g., fifty trays vertically arranged with predetermined intervals kept thereamong in a fixed position in a frame 3 for successively receiving an image formed or printed sheet 2 (FIG. 3) from a printer or another image forming device 1 to accumulate a predetermined number of sheets; a conveying means 5 for conveying the printed sheet 2 from the image forming device 1 toward the distribution bins 4; an indexer 6 provided movable vertically along sheet receiving ends of the plural distribution bins 4 for changing a direction of the sheet 2 conveyed by the conveying means 5 with a curved top-face guide portion to feed and distribute the sheet 2 to each distribution bin 4; and a stapler 7 being movable vertically and horizontally along the sheet receiving end of the distribution bin 4 to staple and bundle a bunch of sheets.

When the image forming device 1 is a printer, especially, a stencil printer, a large number of sheets can be printed in a short time. The sheet 2 with a wet ink loaded thereon is discharged at a high speed. In the conveying means 5 for conveying the sheet 2 from the image forming device 1 to the indexer 6, during conveying, a rear face of the sheet 2 is drawn and held to be kept away from a surface of another sheet.

As shown in FIG. 2, the conveying means 5 is constituted of a first conveying portion 5A for conveying the sheet 2 discharged from a discharge portion of the image forming device 1 obliquely upward to an upper portion of a body, a second conveying portion 5B for conveying the sheet 2 from the upper portion downward to the indexer 6, and a curved portion 5C provided on an upper end of the second conveying portion 5B for receiving the sheet 2 from the first conveying portion 5A and curving the sheet 2 in a conveying direction at an acute angle.

Figure 3:
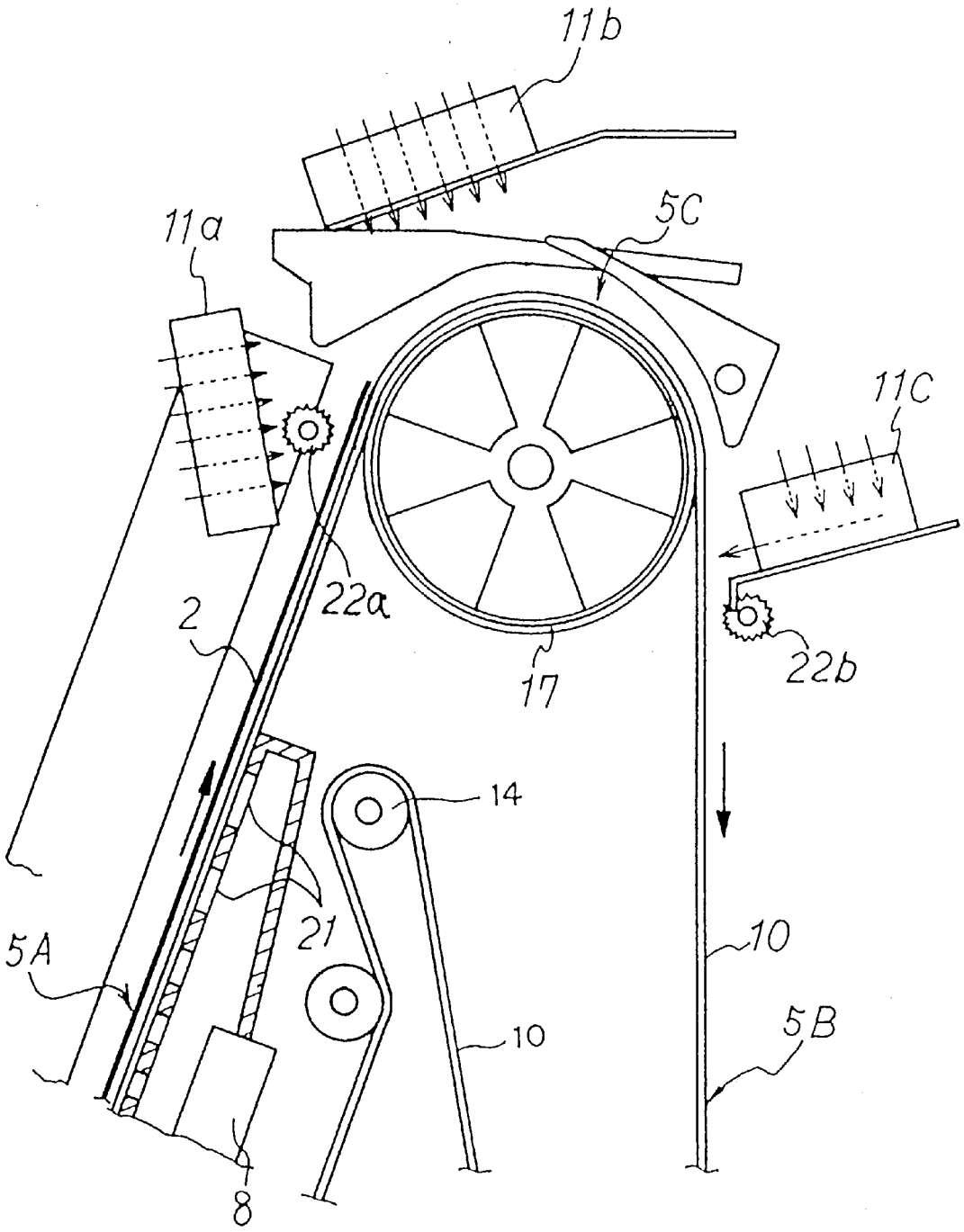
FIG. 3 is a side view showing a vicinity of a curved portion of a conveying means.
Figure 4:
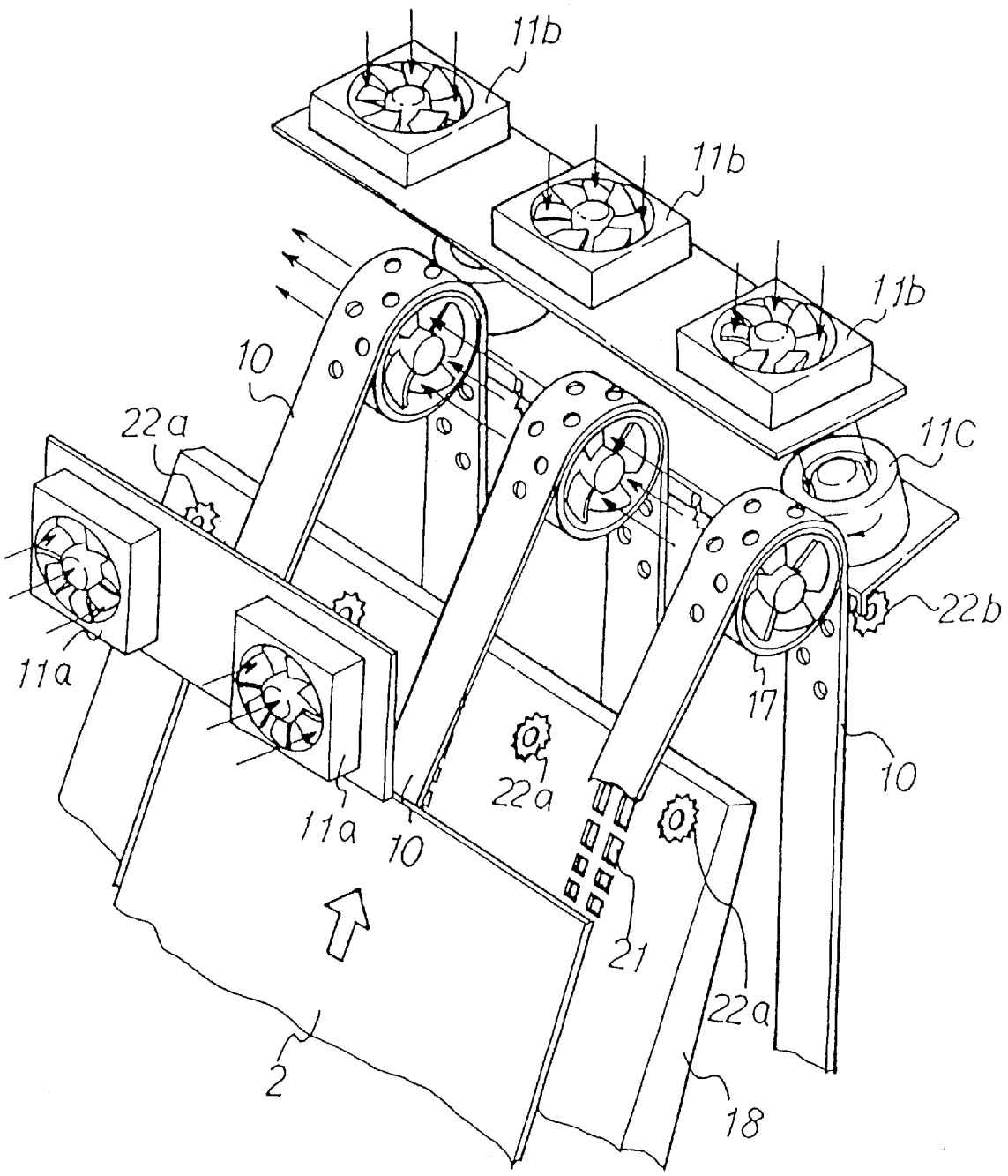
FIG. 4 is an exploded perspective view showing the vicinity of the curved portion of the conveying means.

The first conveying portion 5A is divided into an upstream conveying portion and a downstream conveying portion. In the upstream conveying portion, a perforated conveying belt 9 is extended between belt pulleys 20*a* and 20*b* on both ends, and suction blowers 8 are disposed inside the conveying belt 9, so that the rear face of the sheet 2 is drawn and held during conveying. In the downstream conveying portion, a perforated conveying belt 10 is extended directly from a belt pulley 16 to a belt pulley 17 of the second conveying portion 5B, so that the sheet 2 can be smoothly delivered from the first conveying portion 5A to the second conveying portion 5B without the sheet 2 skewing between the conveying portions 5A and 5B. Also, inside the downstream conveying portion of the first conveying portion 5A and the second conveying portion 5B, the suction blowers 8 are disposed in the same manner as aforementioned. On a rear side of the upper proximal end of the downstream conveying portion, there is provided a U-turn roller 14 for returning the perforated conveying belt 10 from the second conveying portion 5B to the first conveying portion 5A. In the curved portion 5C disposed is an air blower 11 which blows an air current to press the sheet 2 against a curved conveying face. Especially, for a vicinity structure of the curved portion 5C, as shown in FIGS. 3 and 4, around the upper end of the first conveying portion 5A, a box-like duct 18 is disposed on rear sides of the perforated conveying belts 10. Also, a pressure inside the duct 18 is reduced by the suction blowers 8. Further, the duct 18 has openings 21 which open toward the conveying belts 10 to draw and hold the sheet 2. The duct 18 is tapered in such a manner that the duct 18 becomes thinner, that is, the cross-sectional area thereof becomes smaller as the duct 18 is apart from the suction blowers 8. Also, the openings 21 are small near the suction blowers 8, and gradually become larger apart from the suction blowers 8. A suction retention force by means of the suction blowers 8 can be uniformed, while a sheet holding force is controlled.

Also, in the curved portion 5C on the upper end of the second conveying portion 5B, three large-diameter belt pulleys 17 are disposed, around which the perforated conveying belts 10 from the first conveying portion 5A are extended to be run and operated. Also, three air blowers 11*a*, 11*b* and 11*c* are directed toward a conveying face of the curved portion 5C to blow an air current thereto. By means of a pressure of the air current, the sheet 2 is bent or deformed along the curved configuration of the conveying face. By running the conveying belts 10, the sheet 2 is conveyed via the curved portion 5C downward to the indexer 6 by the second conveying portion 5B. Further, in the embodiment, in the vicinity of the air blowers 11*a* and 11*c* on the front and rear side of the curved portion 5C, a plurality of small press rollers 22*a* and 22*b* with saw teeth formed on peripheral faces are arranged in a transverse direction. In the curved portion 5C for curving the sheet 2 at an acute angle in the conveying direction, the press rollers 22*a* and 22*b* press and prevent the tip end of the sheet 2 from bouncing up. The press rollers 22*a* and 22*b* are effectively operative, especially, for conveying a thick sheet. Additionally, the press rollers 22*a* and 22*b* can be selectively operated in accordance with the types of sheets to be conveyed.

Also, as shown in FIG. 1, on the opposite side of the image forming device 1, the sheet distribution device S is cascade-connected to plural units of a slave machine S1 which has the same constitution as the body of the sheet distribution device S. The number of the distribution bins 4 can thus be increased. When the slave machine S1 is connected, a third conveying portion 5D (junction conveying portion) for conveying the sheet 2 to the slave machine S1 is detachably attached to the upper portion. Also, as shown in FIG. 2, a switch mechanism 12 is disposed in a vicinity of the curved portion 5C of the main sorter unit S1 for selectively conveying the sheet 2 conveyed from the first conveying portion 5A to the second conveying portion 5B or the third conveying portion 5D (FIG. 1). In the embodiment, as shown in FIGS. 1 and 2, a space 19 for storing the third conveying portion 5D is horizontally formed in the upper portion of the sheet distribution device S. The first conveying portion 5A of the slave machine S1 can be inserted and fixed in the space 19 so that the plural sheet distribution devices S can be connected.

Also, the image forming device 1 is provided with a discharged sheet base 13 for accumulating the discharged sheets 2 when they are not sorted. Also, on an outer wall face of the sheet distribution device S attached is an outside electromotive stapler 15.

In the sheet distribution device S, as shown in FIG. 2, in the vicinity of the receiving end of the top distribution bin 4 and the receiving end of the lowermost distribution bin 4, a light emission sensor 23*a* and a light receiving sensor 23*b* are provided. The light emission sensor 23*a* detects that the sheet 2 fed from the indexer 6 is stored in the distribution bin 4, while the light receiving sensor 23*b* detects that a bunch of sheets are pushed out to a position in which the bunch can be stapled.

Figure 5:
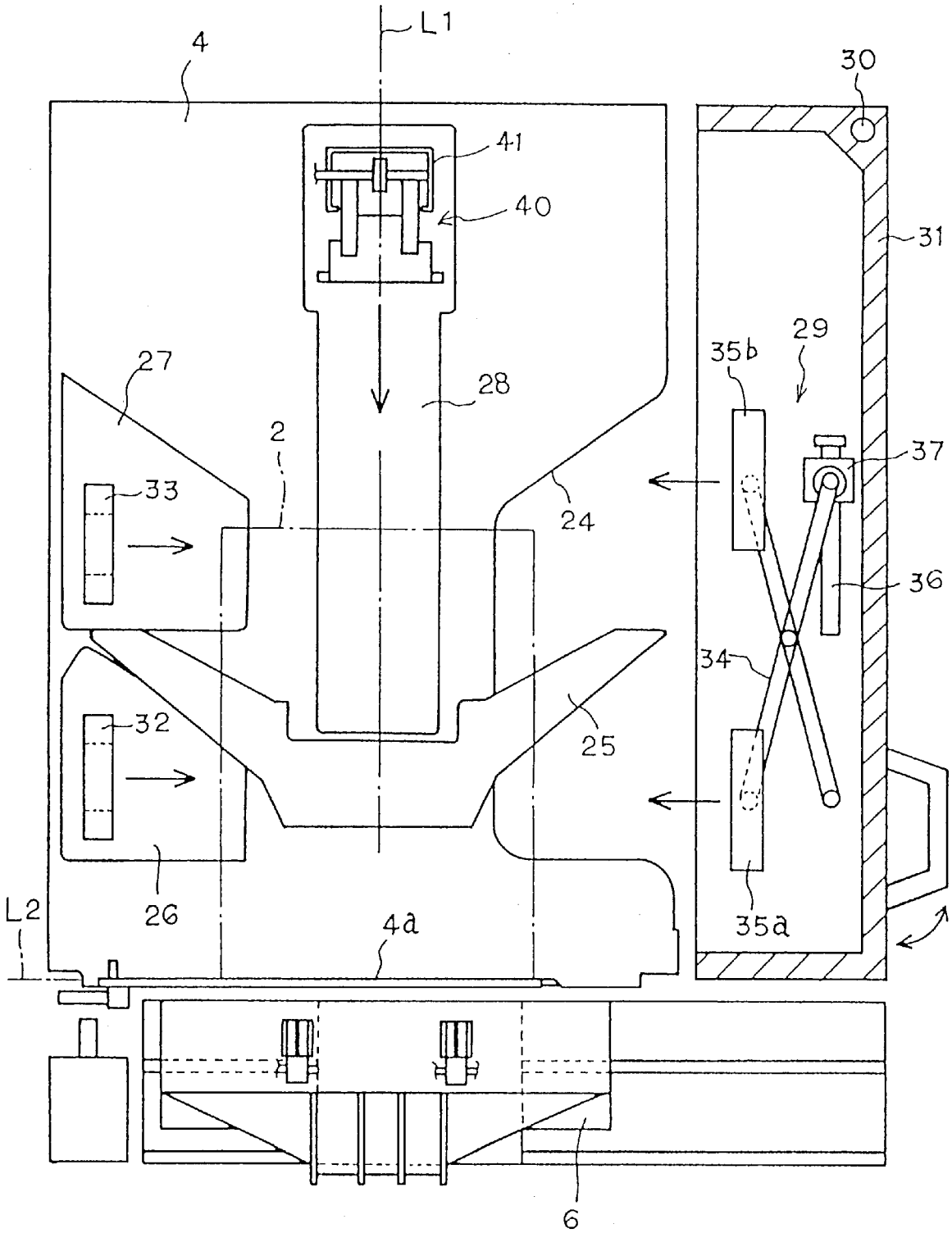
FIG. 5 is a plan view of a distribution bin in the sheet distribution device.

As shown in FIG. 5, the distribution bin 4 is a rectangular flat plate, and has in one side a large notched portion 24 via which the sheet 2 can be easily taken out. Also, on a top face of the distribution bin 4 disposed is a substantially V-shaped sheet support plate 25 which is protruded to a middle portion of the notched portion 24 to prevent the sheet 2 from hanging down. In the distribution bin 4, two large openings 26 and 27 are formed on the opposite side of the notched portion 24, and further an elongated guide hole 28 is formed in a back to forth direction in the middle portion. Also, matching members are disposed in the notched portion 24, the openings 26, 27 and the guide hole 28, respectively, so that the sheet 2 is matched with two reference positions L1 and L2. A first matching member 29 provided in the notched portion 24 is housed inside a sheet taking-out door 31 which can be opened/closed about an axis 30. Together with a pair of second matching members 32 and 33 provided in the openings 26 and 27 on the opposite side, the first matching member 29 pushes opposite side edges of the sheet 2 to transversely move the sheet 2. The sheet 2 is thus matched with the middle reference position L1.

Especially, the first matching member 29 housed in the sheet taking-out door 31 is operated by a linkage 34. When the device is inoperative or when the sheet taking-out door 31 is opened/closed, the linkage 34 is contracted and housed in the door 31. On the other hand, when the sheet 2 is matched, the linkage 34 is expanded. Then, one side edge of the sheet 2 is pushed out by a pair of vertically long matching plates 35*a* and 35*b* which are mounted on tip ends of the linkage 34. The first matching member 29 is operated by a screw shaft 36 rotated by a motor (not shown) and a nut 37 which slides on the shaft 36. The operating portion is provided in the lower portion of the sheet taking-out door 31.

Figure 6:
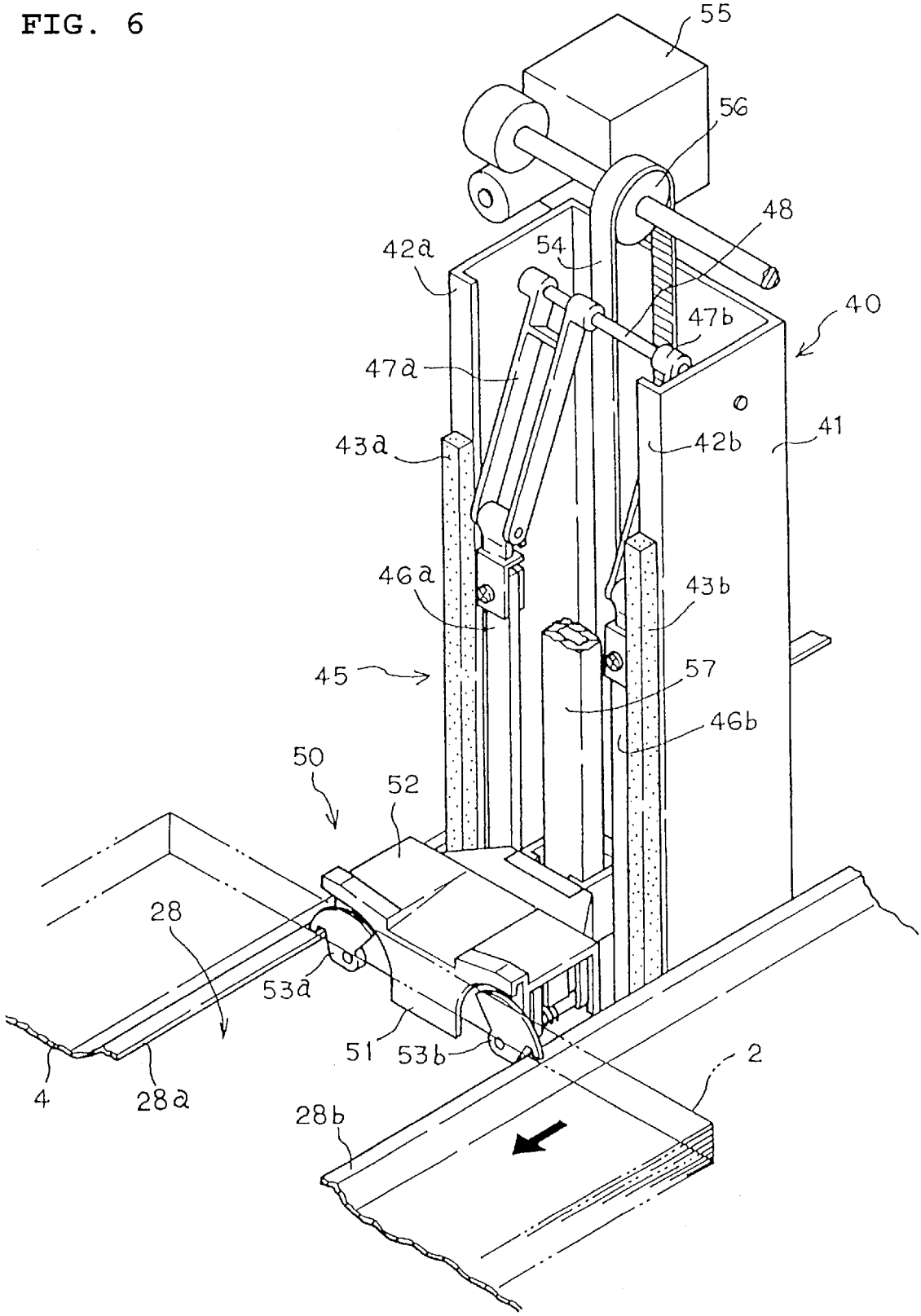
FIG. 6 is an enlarged perspective view showing a sheet matching member and a sheet bunch pushing member.

A third matching member 40 is provided in the middle guide hole 28 for pushing the discharge tip end of the sheet 2 to match the sheet 2 with the reference position L2 along a vertical wall 4*a* which is built on the sheet receiving end of the distribution bin 4. As shown in FIGS. 5 and 6, the third matching member 40 is constituted of a guide rail 41 having a U-shaped cross section which is vertically passed through the distribution bin 4. As abutment faces relative to the printed sheet 2 to be matched, the guide rail 41 has flat vertical faces 42*a* and 42*b* on its edges of an opening. The vertical faces 42*a* and 42*b* are opposed to each other on the sheet receiving end of the distribution bin 4. Elastic members 43*a* and 43*b* formed of sponge or the like are placed along lengths of the vertical faces 42*a* and 42*b*.

Also in the embodiment, a string-like stopper member 45 is extended vertically in front of the third matching member 40. The stopper member 45 elastically thrusts at the discharge tip end of the printed sheet 2 ejected from the indexer 6 toward the distribution bin 4 to moderately stop the sheet 2. For this purpose, used are two bands 46*a* and 46*b* formed of rubber which provides a larger damper effect than sponge. As shown in FIG. 6, upper ends of the rubber bands 46*a* and 46*b* are rotatably attached to tip ends of levers 47*a* and 47*b*. When the sheet 2 thrusts at the rubber bands 46*a* and 46*b* with its discharge tip end, the rubber bands can be largely deflected. Rear ends of the levers 47*a* and 47*b* are supported by a shaft 48 which is extended in the upper end of the guide rail 41. By rotating the shaft 48 with a drive means (not shown), the levers 47*a* and 47*b* are rotated back and forth. Therefore, as shown in FIG. 6, the rubber bands 46*a* and 46*b* can be positioned in front of or behind the elastic members 43*a* and 43*b*. Additionally, lower ends (not shown) of the rubber bands 46*a* and 46*b* are rotatably attached to levers which have the same constitutions as aforementioned.

In the embodiment, a sheet bunch pushing member 50 is provided in front of the guide rail 41. After all the sheets 2 are delivered and distributed by the indexer 6, to staple the sheets as a post-processing, the sheet bunch pushing member 50 pushes out a bunch of sheets accumulated on the distribution bin 4 to an elevating/lowering passage of the indexer 6. As shown in FIG. 6, the sheet bunch pushing member 50 is constituted of a body 52 having a pushing face 51 on its front end, and rotatable engaging members 53*a* and 53*b* provided on opposite sides of the pushing face 51 for engaging with opposite side edges 28*a* and 28*b* of the guide hole 28. When the engaging members 53*a* and 53*b* are rotated inwardly relative to each other, they are disengaged from the side edges 28*a* and 28*b* of the guide hole 28. Then, the body 52 can be moved vertically in the guide hole 28. The sheet bunch pushing member 50 is elevated or lowered by a belt 54 which extends vertically in the guide rail 41. A rear end of the body 52 is fixed to the belt 54. Additionally, in FIG. 6, numeral 55 denotes a motor for operating the belt 54, 56 denotes a pulley around which the belt 54 is extended in a vicinity of a top distribution bin 4, and 57 denotes a guide rod for holding a linearity when the sheet bunch pushing member 50 is elevated or lowered. Also, in order to inhibit the accumulated sheets 2 from hanging down into the guide hole 28, the side edges 28*a* and 28*b* of the guide hole 28 are raised obliquely along peripheral edges to form faces higher than a top face of the distribution bin 4.

Figure 7:
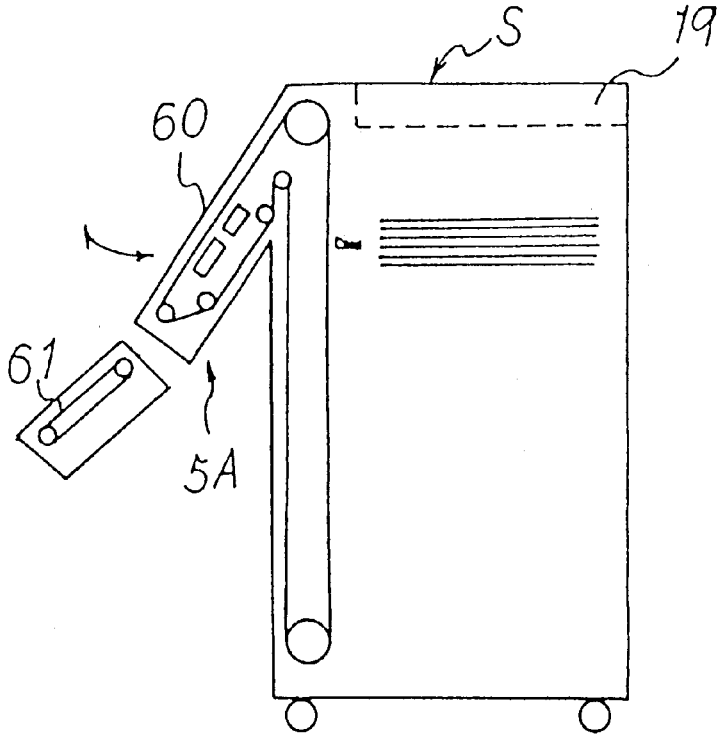
FIGS. 7A and 7B are diagrammatic views showing a constitution of the sheet distribution device according to the invention.
Figure 7:
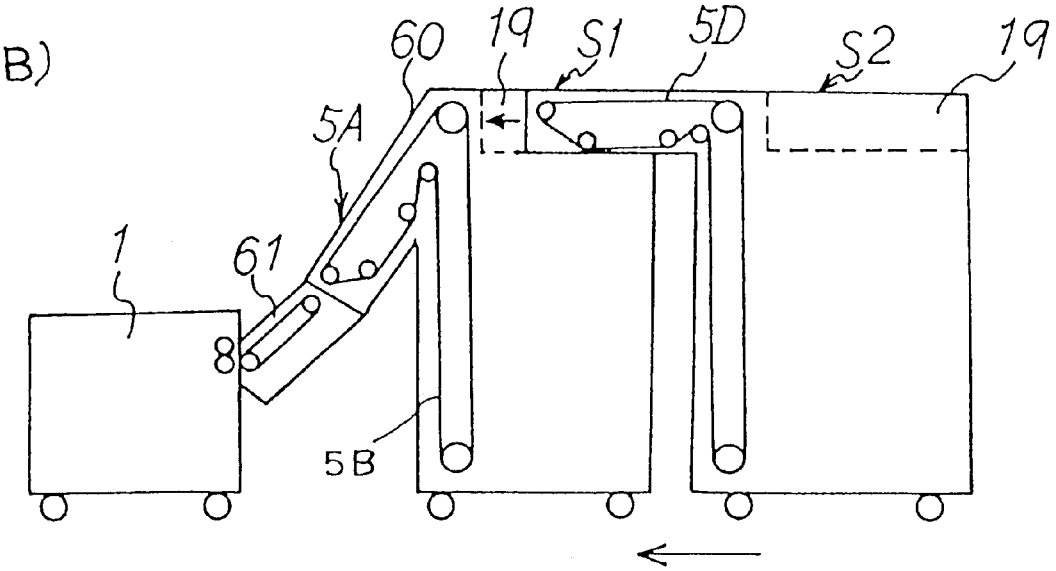
Figure 8:
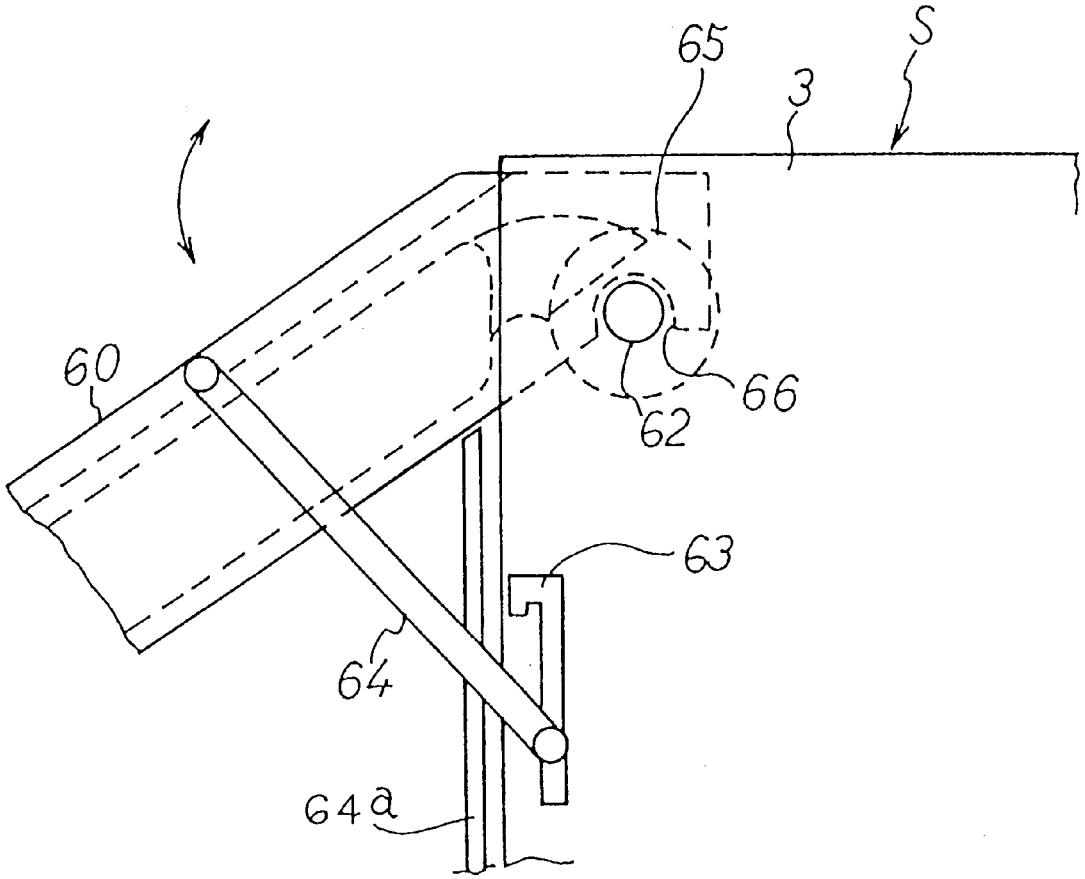
FIG. 8 is a diagrammatic side view showing an attachment structure of a proximal end portion of a first conveying portion.
Figure 9:
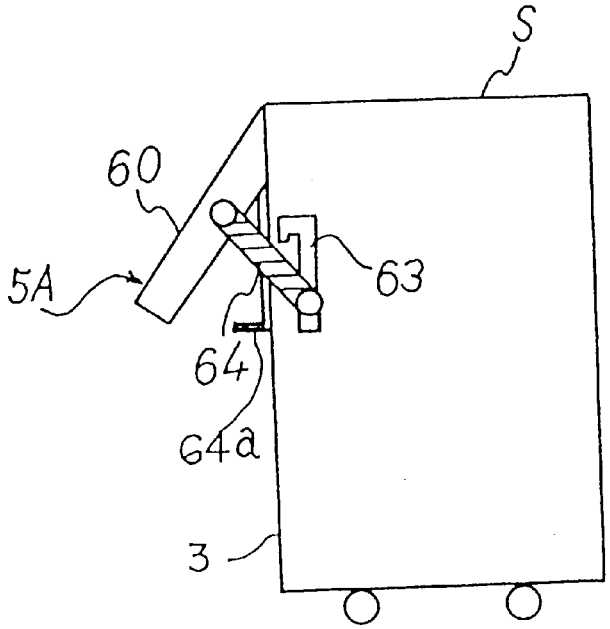
FIGS. 9A and 9B are explanatory views showing an attitude of a downstream-side conveying portion when the sheet distribution device is used as the main sorter unit or a slave sorter unit.
Figure 9:
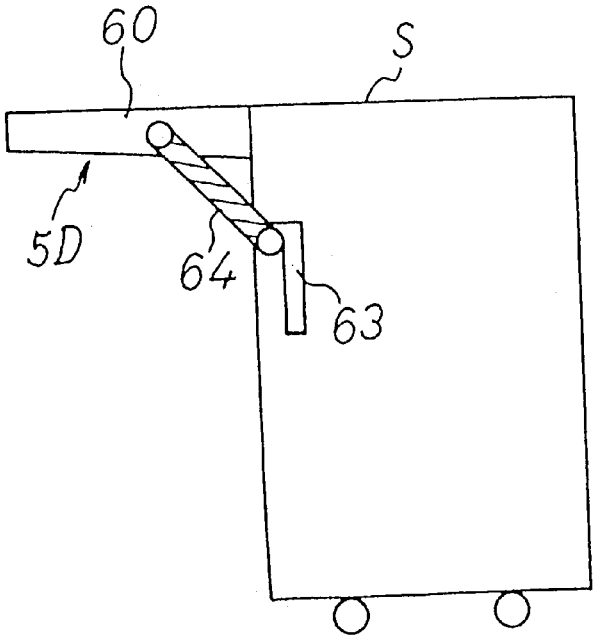

In the sheet distribution device S of the invention, as shown in FIG. 7A, the first conveying means 5A is divided into two near its tip end: a downstream-side conveying portion 60 connected to the body; and an upstream-side conveying portion 61 detachably attached to the sheet distribution device S. In the downstream-side conveying portion 60, as shown in FIG. 8, a semicircular groove 66 provided in a proximal end 65 is engaged from above with a support axis 62 which is fixed to the frame 3 of the sheet distribution device S. The downstream-side conveying portion 60 is thus supported by the support axis 62 and can be rotated vertically about the support axis 62. Also, in a vicinity of a lower portion of the downstream-side conveying portion 60, a substantially inverted J-shaped guide groove 63 is formed in the frame 3. Between the guide groove 63 and the downstream-side conveying portion 60 extended is a support arm 64. One end of the support arm 64 can be slid vertically in the guide groove 63, while the other end thereof is rotatably supported by the downstream-side conveying portion 60. Therefore, when the downstream-side conveying portion 60 is rotated, its predetermined attitude can be held. Also, a support rod 64*a* is detachably attached along the guide groove 63 to the frame 3. As shown in FIG. 9A, when the downstream-side conveying portion 60 is connected as the first conveying means 5A to the image forming device, the support rod 64*a* is attached to the frame 3. Also, one end of the support arm 64 is positioned in a vicinity of a lower end of the guide groove 63. The downstream-side conveying portion 60 can be supported in an steeply inclined condition by an upper end of the support rod 64*a*. On the other hand, as shown in FIG. 9B, when the sheet distribution device S is interconnected on the downstream side of the sheet conveying direction and the downstream-side conveying portion 60 is used as a third conveying portion 5D, then one end of the support arm 64 is engaged with a hook portion on the upper end of the guide groove 63. A substantially horizontal condition can thus be held. Additionally, by providing plural stopper grooves in the guide groove 63, the inclination angle of the downstream-side conveying portion 60 can be freely adjusted in accordance with a connection height of a device to be connected. Also, at the time of packaging, after the support rod 64*a* is detached from the frame 3, one end of the support arm 64 is lowered down to the lower end of the guide groove 63. By rotating downward the downstream-side conveying portion 60 to its substantially perpendicular position, the downstream-side conveying portion 60 can be stored in the body.

Also, as shown in FIG. 7A, in the upper portion of the sheet distribution device S, a space 19 is formed in a horizontal direction for storing the downstream-side conveying portion 60 of the first conveying means 5A when the sheet distribution devices S are interconnected. As shown in FIG. 7B, only when the sheet distribution devices S are interconnected for use, the downstream-side conveying portion 60 of the first conveying means 5A is stored in the space 19. As a junction conveying means from a main sorter unit S1 to a slave sorter unit S2, the third conveying means 5D is constituted. Therefore, when only the main sorter unit SI is sufficient, the unnecessary attachment of the third conveying means 5D is eliminated. Also, the inconvenience of detaching the third conveying means 5D from the main sorter unit S1 can be avoided.

The sheet distribution device S constituted as aforementioned which is interconnected to be used as the main sorter unit S1 or the slave sorter unit S2 will be described. First, in the case of the main sorter unit S1, the first conveying means 5A is constituted only of the downstream-side conveying portion 60 shown in FIG. 7A. The first conveying means 5A may be constituted of the downstream-side conveying portion 60 coupled with the upstream-side conveying portion 61. Then, the tip end of the first conveying means 5A is, as shown in FIG. 7B, connected to a sheet discharge opening of the image forming device 1. On the other hand, when the sheet distribution device S is used as the slave sorter unit S2, as aforementioned, the first conveying means 5A is divided into two. The downstream-side conveying portion 60 is rotated upward, and is kept horizontal with the support arm 64 engaged with the upper-end hook portion of the guide groove 63. Subsequently, as shown in FIG. 7B, the downstream-side conveying portion 60 is inserted to the upper space 19 from the rear side of the main sorter unit S1. The tip end of the downstream-side conveying portion 60 is, as shown in FIG. 10, positioned in a vicinity of a sheet transfer region which is provided with a switch mechanism 12.

Figure 10:
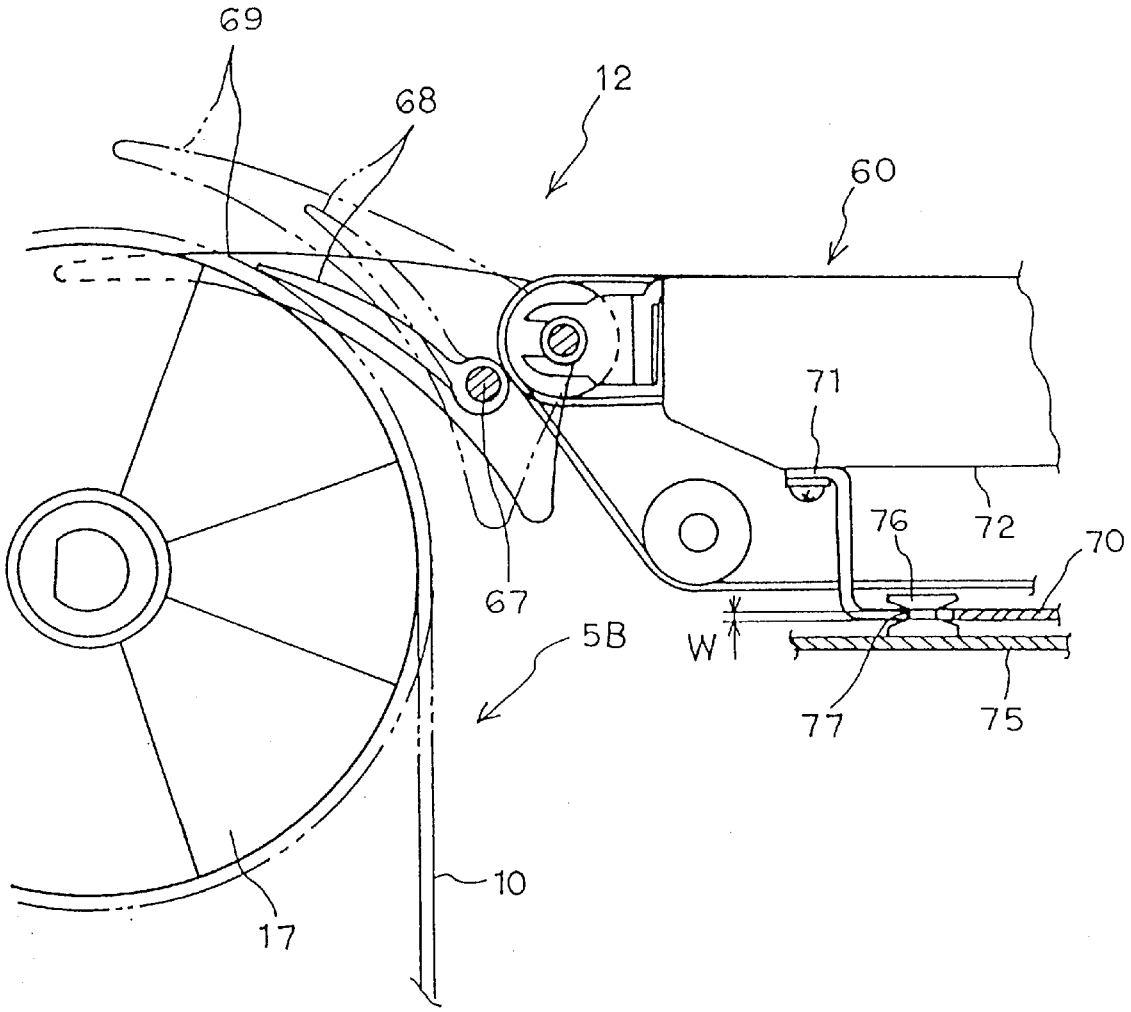
FIG. 10 is a partially sectional side view showing a structure of a vicinity of a tip end portion when a first conveying portion is inserted in a space in the sheet distribution device.
Figure 11:
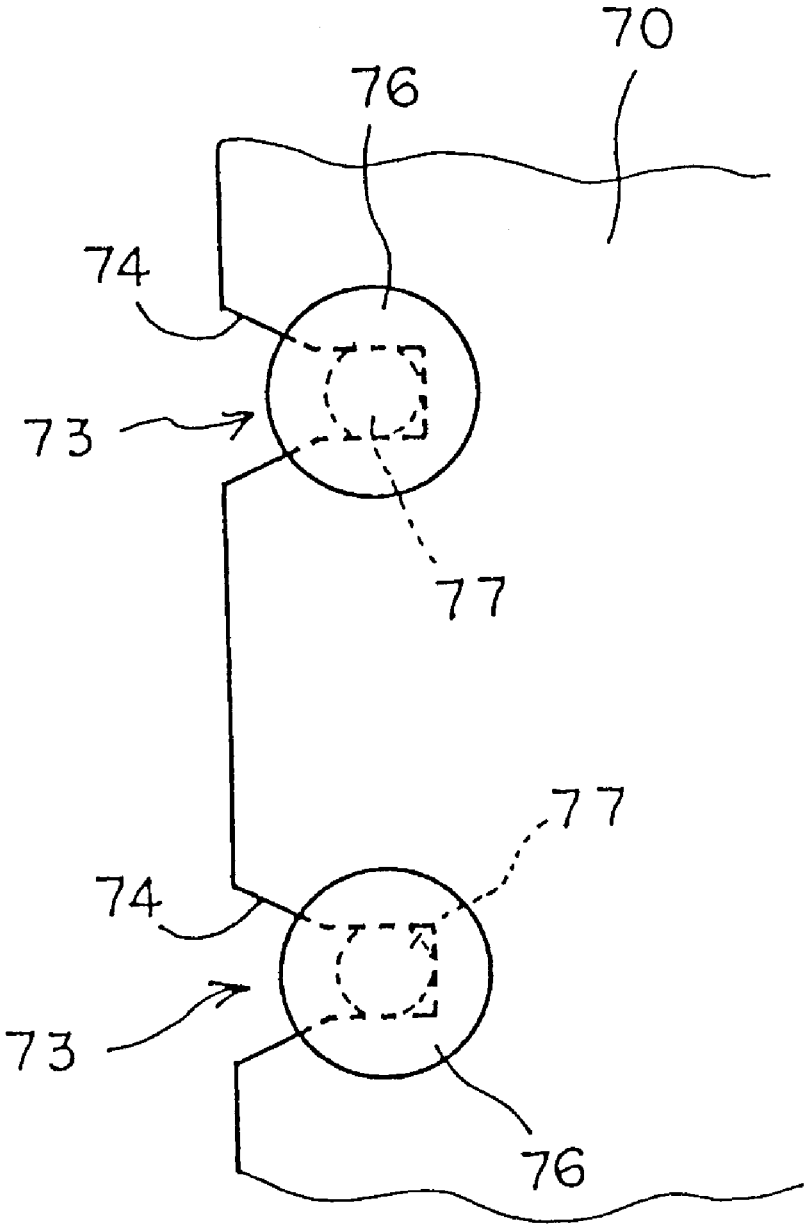
FIG. 11 is a plan view of a support plate which is fixed to a bottom of the downstream-side conveying portion of the first conveying portion.

Under the tip-end portion of the downstream-side conveying portion 60, as shown in FIGS. 10 and 11, a support plate 70 is provided. A flange 71 on a tip end of the support plate 70 is fixed with a screw to a bottom 72. Also, in a tip-end portion of the support plate 70 formed are a pair of opposite engagement grooves 73. The engagement grooves 73 are extended long along an inserting direction of the downstream-side conveying portion 60. On inlet sides of the engagement grooves 73 formed are tapered portions 74, which facilitate insertion of engaging pins 76 described later. On the other hand, on an inner side of a body frame 75 forming the space 19, there are disposed engaging pins 76 for engaging in the engagement grooves 73 when the downstream-side conveying portion 60 is inserted into the space 19. The engaging pins 76 have therein constricted engaging grooves 77 in which peripheral edges of the engagement grooves 73 are engaged. A width W of the engaging groove 77 is substantially the same in size as a plate thickness of the support plate 70. When the engaging pins 76 are engaged in the engagement grooves 73, the support plate 70 is firmly fixed. The height position of the downstream-side conveying portion 60 is thus regulated.

In this manner, the downstream-side conveying portion 60 of the slave sorter unit S2 can be used as the third conveying means 5D of the main sorter unit S1. The switch mechanism 12 positioned on the tip end of the third conveying means 5D (downstream-side conveying portion 60) is rotatable about a support axis 67 for selectively switching a sheet conveying path on the downstream side of the first conveying means 5A to the second conveying portion 5B and the third conveying means 5D. The switch mechanism 12 is constituted of a switch piece 68 for covering the belt 10 in the second conveying portion 5B and a support plate 69 for supporting the switch piece 68.

When a sheet capacity of the distribution bin 4 of the main sorter unit S1 is saturated and the printed sheet 2 needs to be conveyed toward the slave sorter unit S2, then the switch mechanism 12 is operated by an electric solenoid or the like to be switched to a position shown by a solid line in FIG. 10. Therefore, the printed sheet 2 conveyed by the first conveying means 5A is received by the third conveying means SD and conveyed to the slave sorter unit S2. Also, when the slave sorter unit S2 is not connected to the main sorter unit S1, or when the sheet capacity of the main sorter unit S1 with the slave sorter unit S2 connected thereto is not saturated, the switch mechanism 12 is switched to a position shown by an imaginary line in FIG. 10. Then, the printed sheet 2 conveyed by the first conveying means 5A is received by the second conveying portion 5B.

As aforementioned, simply by inserting the first conveying means 5A of the slave sorter unit S2 into the upper space 19 of the main sorter unit S1, the third conveying means SD can be formed on the main sorter unit S1. The attachment is remarkably easy.

Also, an upper portion of the slave sorter unit S2 is provided with the space 19. When further sheet distribution device is interconnected to the downstream side of the slave sorter unit S2, also on the upper portion of the slave sorter unit S2, the third conveying means 5D used also as the first conveying means 5A is formed in the same manner as aforementioned. Additionally, in the embodiment, the space 19 for storing the first conveying means 5A is formed in the upper portion of the sheet distribution device S. Alternatively, the space 19 may be formed in an intermediate or lower portion of the sheet distribution device S.

As aforementioned, according to the sheet distribution device of the invention, the junction conveying means for conveying the sheet from the sheet distribution device on the upstream side of the sheet conveying direction to the sheet distribution device on the downstream side when the sheet distribution devices are interconnected is used also as the first conveying means for conveying the sheet from the image forming device into the body. At the time of interconnection, the first conveying means is stored in the space formed in the body, and constituted as the junction conveying means. Therefore, as compared with the conventional sheet distribution device which is provided beforehand with the junction conveying means, the manufacture cost is reduced. Further, when only one sheet distribution device is used without being interconnected, a troublesome operation for removing the junction conveying means can be avoided.

Also, when the sheet distribution device of the invention is for interconnected use, the sheet distribution device of the same structure can be used as either the main sorter unit or the slave sorter unit. When the sheet distribution device is used as the main sorter unit, the first conveying means may be connected to the image forming device or the like. When the sheet distribution device is used as the slave sorter unit, simply by inserting the first conveying means into the space formed in the body, positioning can be performed. The junction conveying means which securely transfers the sheets can be constituted. The assembly operation is effectively facilitated.

Further, the sheet distribution devices can be manufactured without distinguishing the main sorter units from the slave sorter units. Therefore, package boxes can be used in common. Also in this respect, cost can be saved.

What is claimed is:

1. A sheet distribution device comprising a first conveying means for receiving an image formed sheet from an image forming device to convey the image formed sheet, a body and a second conveying means within the body for receiving the image formed sheet from the first conveying means to each of plural distribution bins, the sheet distribution device being interconnectable, to a second sheet distribution device wherein;

the interconnection is accomplished by inserting the first, conveying means of the second sheet distribution device into the empty volume of the body of the first sheet distribution device for conveying the sheet delivery between the sheet distribution devices.

2. The sheet distribution device according to claim 1 wherein said first conveying means and said second conveying means are directly connected via one sheet conveyor belt.

3. The sheet distribution device according to claim 1 which is provided with a switch mechanism which transfers the image formed sheet conveyed by said first conveying means to either one of the second conveying means and the junction conveying means.

4. The sheet distribution device according to claim 1 wherein said first conveying means can be rotated in a vicinity of a region in which the sheet is transferred to the second conveying means.

5. The sheet distribution device according to claim 4 which is provided with a support member for holding a rotated position of said first conveying means.

6. The sheet distribution device according to claim 1 which is provided with an engagement means for fixing the first conveying means in the space when the sheet distribution devices are interconnected and the first conveying means of the sheet distribution device on the downstream side is inserted to the space in the sheet distribution device on the upstream side of the sheet conveying direction.

7. The sheet distribution device according to claim 6 wherein said engagement means is constituted of an engagement groove formed in a tip-end bottom of said first conveying means and an engaging pin formed on an inner side in said space for engaging with the engagement groove when the first conveying means is inserted.

8. The sheet distribution device according to claim 7 wherein said engaging pin has an engaging groove formed therein for engaging with a peripheral edge of said engagement groove.

* * * * *